US007192206B2

(12) United States Patent
Sawai

(10) Patent No.: US 7,192,206 B2
(45) Date of Patent: Mar. 20, 2007

(54) IMAGE FORMING APPARATUS

(75) Inventor: Kunio Sawai, Daito (JP)

(73) Assignee: Funai Electric Co., Ltd., Osaka (JP)

( * ) Notice: Subject to any disclaimer, the term of this patent is extended or adjusted under 35 U.S.C. 154(b) by 64 days.

(21) Appl. No.: 11/134,347

(22) Filed: May 23, 2005

(65) Prior Publication Data

US 2005/0276648 A1 Dec. 15, 2005

(30) Foreign Application Priority Data

Jun. 11, 2004 (JP) ..... 2004-173391

(51) Int. Cl.
*B41J 2/315* (2006.01)

(52) U.S. Cl. ..... 400/120.01; 400/120.16; 400/120.17

(58) Field of Classification Search ..... 347/197, 347/198, 220–223
See application file for complete search history.

(56) References Cited

FOREIGN PATENT DOCUMENTS

| | | | |
|---|---|---|---|
| JP | 61-005965 | | 1/1986 |
| JP | 01-301351 | | 12/1989 |
| JP | 05-318785 | * | 3/1993 |
| JP | 10-058804 | A | 3/1998 |
| JP | 11-010925 | * | 1/1999 |
| JP | 11-010925 | A | 1/1999 |
| JP | 11-268315 | | 10/1999 |

* cited by examiner

*Primary Examiner*—Judy Nguyen
*Assistant Examiner*—N. Ha
(74) *Attorney, Agent, or Firm*—Global IP Counselors, LLP

(57) ABSTRACT

A thermal printer includes a main frame having side plates, a platen roller rotatably supported in the main frame, a print head unit supported in the main unit so as to be pivotable between an image-forming state and a non-image forming state, a sheet case adapted to accommodate a sheet, and a contact portion that is attached to the print head unit so as to pivot together with the print head unit. The print head unit is pressed against the platen roller to convey a sheet therebetween when the print head unit is in the image-forming state. The sheet case is mounted in the main frame through an insertion part formed in one of the side plates. The contact portion contacts the sheet case from a second side plate side when the print head unit is in the image-forming state. It is possible to reduce the occurrence of printing defects.

10 Claims, 7 Drawing Sheets

IMAGE FORMING APPARATUS

BACKGROUND OF THE INVENTION

1. Field of the Invention

The present invention relates to an image forming apparatus. More specifically, the present invention relates to an image forming apparatus that has a print head unit for printing.

2. Background Information

Image forming apparatuses that have a print head unit for printing have been known conventionally. For example, Japanese Patent Application Publications Nos. 11-10925 and 10-58804 disclose such image forming apparatuses.

Japanese Patent Application Publication No. 11-10925 discloses a printer configured such that a ribbon cassette (ink sheet case) is fixedly positioned within the printer, and a head unit is pressed against a platen (a platen roller) by having a lever (locking member) that is attached to the head unit (print head unit) engage a locking pin provided at the side plate of the printer (an example of an image forming apparatus).

Also, Japanese Patent Application Publication No. 10-58804 discloses a heat transfer recording apparatus (image forming apparatus) in which a locking device (locking member) attached to a housing (frame) engages an ink cartridge (ink sheet case), such that the ink cartridge is fixedly positioned within the heat transfer recording apparatus.

A heat transfer printer is a known example of an image forming apparatus. FIG. 13 is a perspective view showing the entire configuration of a conventional example of a heat transfer printer. FIG. 14 is a front view showing a locking member engaged with an ink sheet case in the conventional example of a heat transfer printer shown in FIG. 13. The structure of an example of a conventional heat transfer printer will now be described with reference to FIGS. 13 and 14.

As shown in FIG. 13, a conventional heat transfer printer has a metal frame 101 having a first side surface 101*a* and a second side surface 101*b*, a thermal head unit 102 for printing, a platen roller 103, a platen roller bearing 104 for rotatably supporting the platen roller 103, an ink sheet case 105 for accommodating ink sheets, a locking member 106 for fixedly positioning the ink sheet case 105 in place, a metal shaft 107, two press members 108, a drive gear 109, a motor bracket 110, and an intermediate gear 111. The drive gear 109 has a small gear 109*a* and a large gear 109*b* made of a resin and pivots the press member 108 on the first side surface 101*a* of the frame 101. Furthermore, a motor bracket 110 is attached to the first side surface 101*a*.

The second side surface 101*b* opposite the first side surface 101*a* of the frame 101 is provided with an ink sheet insertion part 101*c* through which the ink sheet case 105 is mounted. A concavity 105*a* that engages the engaging unit 106*a* of the locking member 106 is provided at a predetermined location of this ink sheet case 105.

The locking member 106 has a supporting part 106*b*, a plate spring 106*c*, and a gripping part 106*d*, as shown in FIGS. 13 and 14. This supporting part 106*b* is coupled to the second side surface 101*b* of the frame 101 to pivotably support the locking member 106. Also, the plate spring 106*c* comes into contact with a bent section 101*d* of the second side surface 101*b* of the frame 101, and urges the engaging unit 106*a* of the locking member 106 downward. The gripping part 106*d* is configured such that when the gripping part 106*d* is brought upward when the urging force of the plate spring 106*c*, the engaging unit 106*a* is separated from the concavity 105*a* of the ink sheet case 105. Also, the bent section 101*d*, which comes into contact with the plate spring 106*c* of the locking member 106, is formed at the top of the second side surface 101*b* of the frame 101. The first side surface 101*a* and second side surface 101*b* of the frame 101 are provided with insertion holes 101*e* through which both ends of the shaft 107 are rotatably inserted, as shown in FIG. 13.

The thermal head unit 102 is mounted in between the first side surface 101*a* and the second side surface 101*b* of the frame 101, so as to be capable of pivoting around the supporting shaft. A head bottom part 102*a* provided to the bottom of the thermal head unit 102 is disposed so as to face the platen roller 103. Bent parts 102*b* pressed on by the press members 108 are formed above both ends of the head bottom part 102*a* of the thermal head unit 102. The thermal head unit 102 is normally urged in a direction away from the platen roller 103 by an urging member (not shown in Figures).

The two press members 108 are unrotatably coupled to near the two ends of the shaft 107. Shaft supports 107*a* are formed on both ends of the shaft 107, outside the portions to which the press members 108 are coupled. These shaft supports 107*a* are rotatably supported in the insertion holes 101*e* of the frame 101. Also, press springs 108*a* that apply pressure to the two bend-worked parts 102*b* of the thermal head unit 102 are affixed to the two press members 108. Furthermore, the press member 108 next to the first side surface 101*a* of the frame 101 is disposed so as to engage the small gear 109*a* of the drive gear 109. The drive gear 109 is coupled to the first side surface 101*a* of the frame 101, and transmits driving force from the intermediate gear 111 to the press members 108. The driving force of a motor (not shown) is transmitted to the large gear 109*b* of the drive gear 109 via the intermediate gear 111.

In the pressing operation for the platen roller 103 of the thermal head unit 102 in the conventional heat transfer printer described above, the driving force of the motor (not shown) is transmitted to the press member 108 that is on the first side surface 101*a* side of the frame 101 via the intermediate gear 111 and the large gear 109*b* and small gear 109*a* of the drive gear 109. Accordingly, the press member 108 on the first side surface 101*a* side of the frame 101 thereby pivots while being supported by the shaft 107. As a result, the bent part 102*b* next to the first side surface 101*a* of the frame 101 is pressed on by the press spring 108*a* of the press member 108. Since the two press members 108 are unrotatably coupled to near ends of the shaft 107, the shaft 107 and the press member 108 on the second side surface 101*b* side of the frame 101 pivot as a result of the pivoting of the press member 108 on the first side surface 101*a* side. The bent part 102*b* on the second side surface 101*b* side of the frame 101 is thereby pressed on by the press spring 108*a* of the press member 108 next to the second side surface 101*b*. As a result, the head bottom part 102*a* of the thermal head unit 102 is pressed on by the platen roller 103 against the urging force of the urging member (not shown).

In the conventional heat transfer printer shown in FIGS. 13 and 14, the locking member 106 is mounted on the second side surface 101*b* of the frame 101 in order to prevent the ink sheet case 105 from moving in the width direction of the thermal head unit 102 (the direction of the arrow E in FIG. 13). However, with this locking member 106, the engaging unit 106*a* separates from the concavity 105*a* of the ink sheet case 105 when the gripping part 106*d* being brought up, and the ink sheet case 105 therefore moves in the width direction of the thermal head unit 102 (the direction of the arrow E in FIG. 13) if the gripping part 106*d* is mistakenly brought up during printing. In this case, printing defects tend to result.

Also, in the structure disclosed in Japanese Patent Application Publication No. 11-10925, a locking member for securing the ink sheet case in place in the image forming apparatus is coupled to the print head unit. Therefore, the print head unit separates from the platen roller if the locking member is mistakenly released from a locking pin. In that case, printing defects result.

Also, in the structure disclosed in Japanese Patent Application Publication No. 10-58804, a locking member for securing the ink sheet case in place in the image forming apparatus engages the ink sheet case. Therefore, the ink sheet case moves relative to the image forming apparatus if the locking member is mistakenly released from the ink sheet case. In that case also, printing defects result.

In view of the above, it will be apparent to those skilled in the art from this disclosure that there exists a need for an improved image forming apparatus that overcomes the problems of the conventional art. This invention addresses this need in the art as well as other needs, which will become apparent to those skilled in the art from this disclosure.

SUMMARY OF THE INVENTION

An object of the present invention is to provide an image forming apparatus that is capable of reducing the occurrence of printing defects.

The image forming apparatus according to the first aspect of the present invention is adapted to form an image on a sheet, and includes a main frame having first and second side plates, a platen roller rotatably supported in the main frame, a print head unit supported in the main unit so as to be pivotable between an image-forming state and a non-image forming state, a sheet case adapted to accommodate a sheet, and a contact portion that is attached to the print head unit so as to pivot together with the print head unit. An insertion part is formed on the second side plate. The print head unit is pressed against the platen roller to convey a sheet therebetween when the print head unit is in the image-forming state. The sheet case is designed to be mounted in the main frame through the insertion part. The contact portion contacts the sheet case from a second side plate side when the print head unit is in the image-forming state.

In the image forming apparatus according to the first aspect of the present invention, the print head unit is provided with a contact unit that contacts the sheet case from the second side plate during the printing operation. Thus, it is possible to prevent the sheet case from moving relative to the print head unit with the contact unit of the print head unit. It is thereby possible to reduce the occurrence of printing defects.

In the image forming apparatus according to second aspect of the present invention, the sheet case includes a sheet feeder, a sheet take-up unit, and a linking unit that links the sheet feeder and the sheet take-up unit. The contact portion comes into contact with the linking unit of the sheet case when the print head unit is in the image-forming state. With such configuration, the sheet case can be easily prevented from moving relative to the print head unit.

In the image forming apparatus according to the third aspect of the present invention, at least one of the contact unit and the linking unit of the sheet case is elastically deformed when the print head unit is in the image-forming state and the contact unit is in contact with the linking unit of the sheet case. With such configuration, the print head unit can be pressed toward the first side plate due to the urging force from the elastic deformation of at least one of the linking unit and the contact unit of the ink sheet case. It is thereby possible to prevent the print head unit from moving toward the opposite second side plate. Therefore, the occurrence of printing defects resulting from positioning misalignments of the print head unit can be further reduced.

In the image forming apparatus according to the fourth aspect of the present invention, a guide unit that is coupled to the print head unit and is adapted to guide the sheet being conveyed is further provided. The contact portion is formed unitarily with the guide unit. With such configuration, the number of components does not increase even though a contact unit is provided.

In the image forming apparatus according to the fifth aspect of the present invention, a locking member that is provided in the second side plate of the main frame and designed to disengageably engage the sheet case is further provided. In this case, the locking member is provided to prevent the sheet case from moving toward the second side plate. In the present invention, however, even when the engagement of the locking member with the sheet case and the second side plate is inadvertently released during the printing operation, it is still possible to prevent the sheet case from moving toward the second side plate relative to the print head unit due to the contact of the contact unit of the print head unit. It is thereby possible to reduce the occurrence of printing defects.

In the image forming apparatus according to the sixth aspect of the present invention, at least one of the contact unit and the sheet case is elastically deformed when the print head unit is in the image-forming state and the contact unit is in contact with the sheet case.

In the image forming apparatus according to the seventh aspect of the present invention, a guide unit that is coupled to the print head unit and is adapted to guide the sheet being conveyed is further provided. The contact portion is formed unitarily with the guide unit. The contact unit is elastically deformed when the print head unit is in the image-forming state and the contact unit is in contact with the sheet case.

In the image forming apparatus according to the eighth aspect of the present invention, the contact portion has a tapered part that decreases its thickness in a downward direction.

In the image forming apparatus according to the eighth aspect of the present invention, the print head unit is a thermal head, and the image forming apparatus is a heat transfer printer.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Embodiments of the present invention will now be described with reference to the diagrams.

Figure 1:
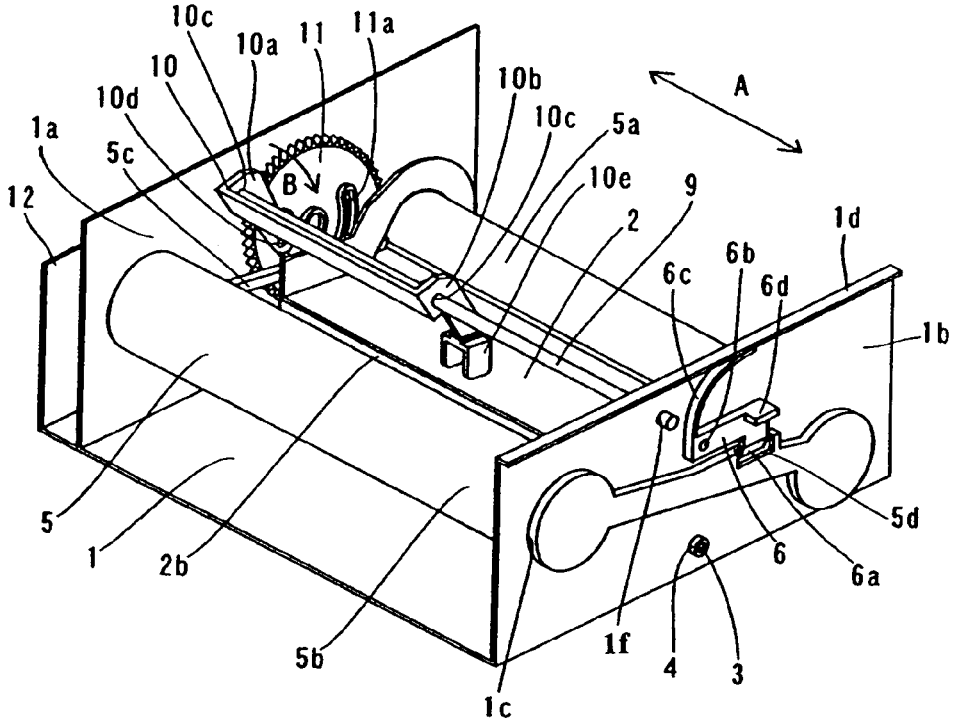
FIG. 1 is a perspective view of the entire configuration of the heat transfer printer according to one embodiment of the present invention viewed from the second side plate side.
Figure 2:
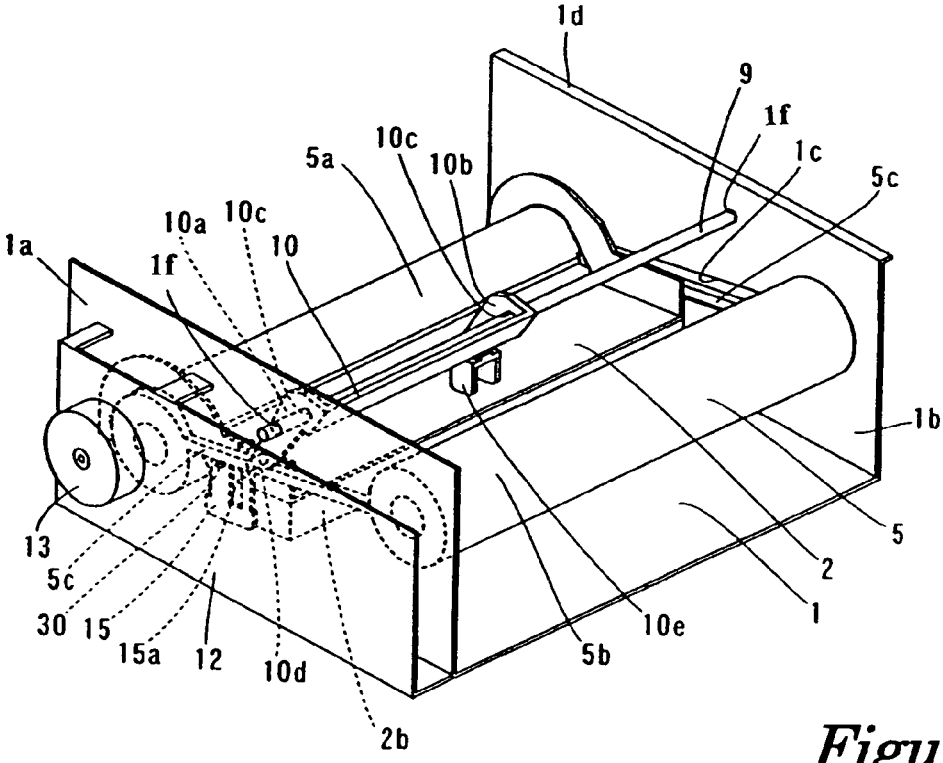
FIG. 2 is a perspective view of the entire configuration of the heat transfer printer according to the embodiment of the present invention viewed from the first side plate side.
Figure 3:
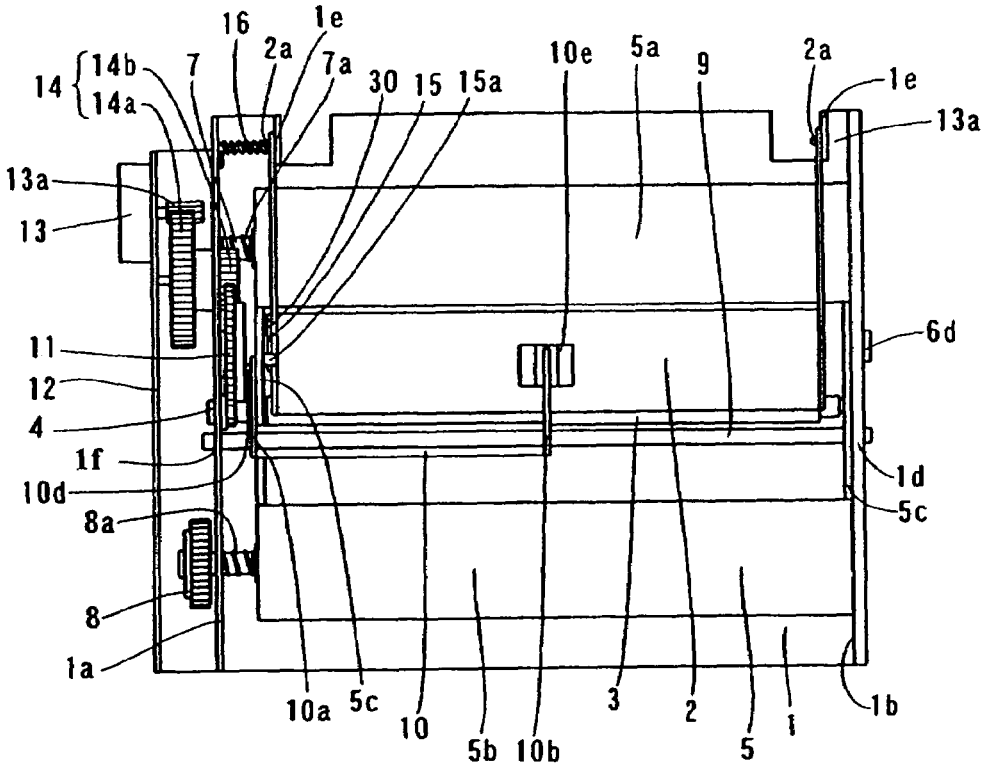
FIG. 3 is a plan view of the heat transfer printer shown in FIGS. 1 and 2 according to the embodiment of the present invention.
Figure 4:
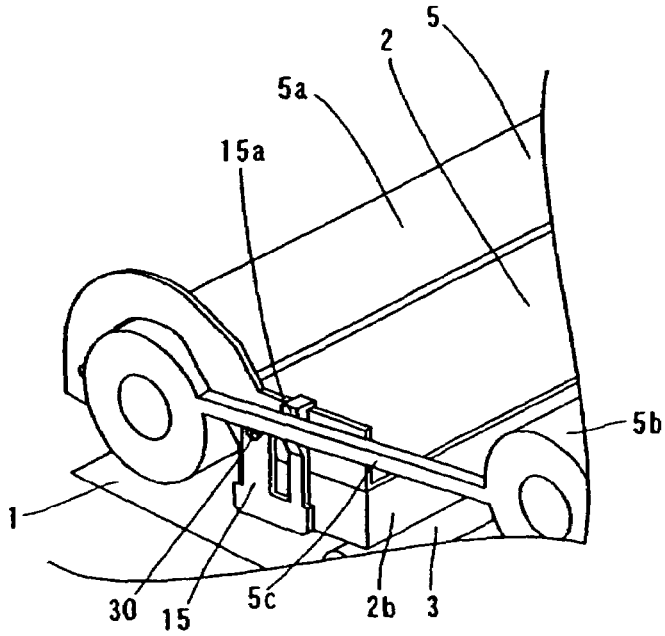
FIG. 4 is a partial perspective view of the detailed structure of the contact unit of the heat transfer printer shown in FIGS. 1 and 2 according to the embodiment of the present invention.

FIGS. 1 and 2 are perspective views showing the entire configuration of a heat transfer printer according to one embodiment of the present invention. FIG. 3 is a plan view of the heat transfer printer according to the embodiment shown in FIGS. 1 and 2. FIG. 4 is a perspective view for describing the detailed structure of the contact unit of the heat transfer printer according to the embodiment shown in FIGS. 1 and 2. FIGS. 5 through 12 are diagrams showing the detailed structure of the heat transfer printer according to the embodiment shown in FIGS. 1 and 2.

First, the structure of the heat transfer printer according to the embodiment of the present invention will be described with reference to FIGS. 1 through 12. In the present embodiment, a heat transfer printer will be discussed as one example of the image forming apparatus of the present invention.

As shown in FIG. 1, the heat transfer printer according to the embodiment of the present invention has a metal frame 1 having a first side surface 1*a* and a second side surface 1*b*, a thermal head unit 2 for printing, a platen roller 3, a platen roller bearing 4 for rotatively supporting the platen roller 3, an ink sheet case 5 made of a resin for accommodating ink sheets, and a locking member 6 for disengageably engaging the ink sheet case 5 and the second side surface 1*b* and supporting the ink sheet case 5 to the second side surface 1*b*. The thermal head unit 2 is supported to the main frame 1 so as to be pivotable between the printing position shown in FIG. 6 and non-printing position shown in FIG. 8. The thermal head unit 2 is pressed against the platen roller 3, conveying the ink sheet therebetween during the printing operation.

As shown in FIG. 3, the heat transfer printer also has an ink sheet feeder support member 7 and an ink sheet take-up member 8 on which the ink sheet case 5 is mounted, as well as a metallic supporting rod 9, a metallic pivot member 10, a drive gear 11 for pivoting the pivot member 10, a motor bracket 12, a motor 13 with a motor shaft gear 13*a*, an intermediate gear 14 having a large gear 14*a* that engages the motor shaft gear 13*a* and a small gear 14*b* that engages the drive gear 11, a paper guide member 15 (see FIG. 2) made of a resin, and a torsion coil spring 16. The thermal head unit 2 is an example of a "print head unit" of the present invention, the locking member 6 is an example of the "locking member" of the present invention, and the paper guide member 15 is an example of the "guide unit" of the present invention.

As shown in FIG. 1, an ink sheet insertion part 1*c*, through which the ink sheet case 5 is mounted in between the first and the second side surfaces 1*a* and 1*b* of the main frame 1, is provided at the second side surface 1*b* which is opposite the first side surface 1*a*. The motor bracket 12 of the frame 1 is mounted on the first side surface 1*a*.

Figure 10:
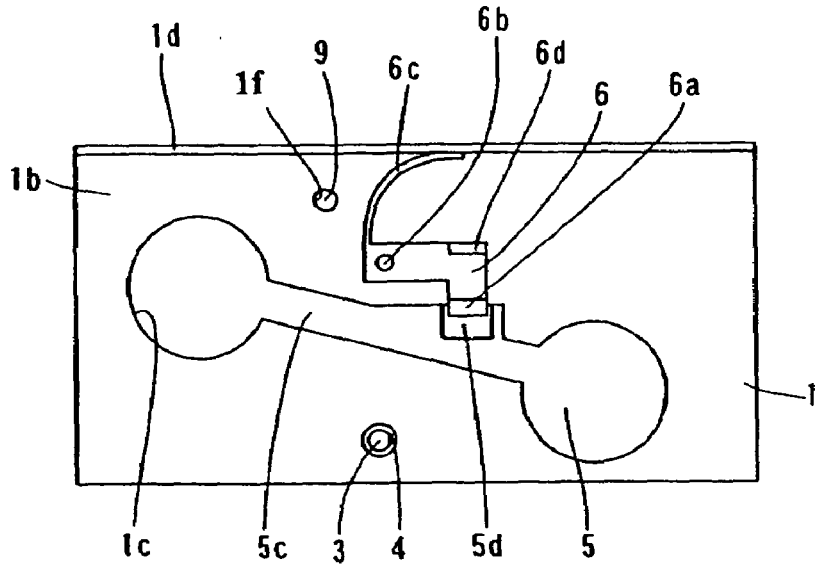
FIG. 10 is a schematic side elevational view of the heat transfer printer shown in FIGS. 1 and 2 according to the embodiment of the present invention, showing the locking member being engaged with the ink sheet case.

The ink sheet case 5 has an ink sheet feeder 5*a*, an ink sheet take-up unit 5*b*, and a linking unit 5*c* for linking the ink sheet feeder 5*a* and the ink sheet take-up unit 5*b*. The ink sheet feeder 5*a* and the ink sheet take-up unit 5*b* are mounted on the ink sheet feeder support member 7 and the ink sheet take-up member 8, respectively, as shown in FIG. 3. The ink sheet feeder support member 7 and the ink sheet take-up member 8 are provided with compression coil springs 7*a* and 8*a* for urging the ink sheet case 5 towards the second side surface 1*b*. A concavity 5*d* is formed at a specific location in the linking unit 5*c* of the ink sheet case 5 as shown in FIG. 10, such that the engaging unit 6*a* of the locking member 6 engages the concavity 5*d*.

Figure 11:
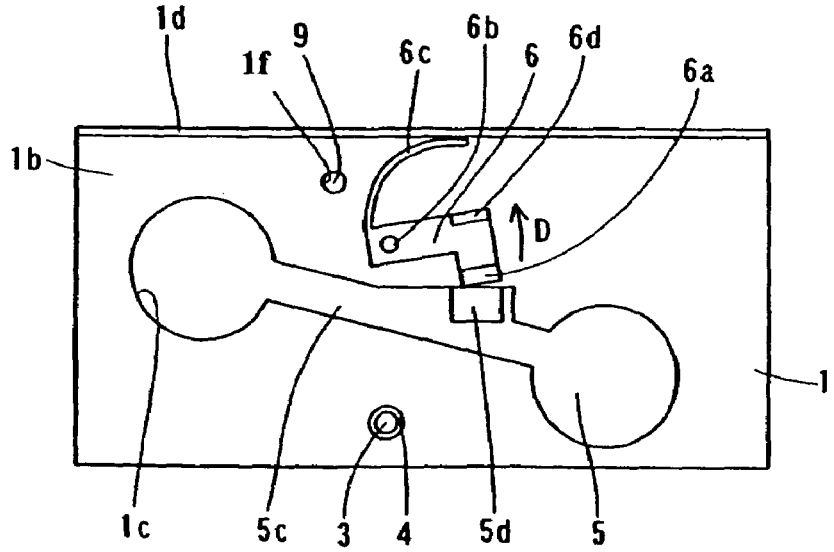
FIG. 11 is a schematic side elevational view of the heat transfer printer shown in FIGS. 1 and 2 according to the embodiment of the present invention, showing the locking member being released from the engagement with the ink sheet case.

The engaging unit 6*a* of the locking member 6 is formed in a tapered shape such that its thickness decreases downward, as shown in FIG. 1. Accordingly, when the ink sheet case 5 is inserted into the ink sheet insertion part 1*c* of the frame 1, the locking member 6 pivots in the direction of the arrow D around a supporting unit 6*b* as shown in FIG. 11, and the linking unit 5*c* of the ink sheet case 5 comes into contact with the tapered surface of the engaging unit 6*a* of the locking member 6. When the ink sheet case 5 is inserted up to a specific position, the engaging unit 6*a* of the locking member 6 engages the concavity 5*d* of the ink sheet case 5, as shown in FIG. 10.

The locking member 6 also has a supporting unit 6*b*, a plate spring 6*c*, and a gripping part 6*d*. This supporting unit 6*b* is mounted on the second side surface 1*b* of the frame 1, and pivotably supports the locking member 6. Also, the plate spring 6*c* comes into contact with a bent section 1*d* of the second side surface 1*b* of the frame 1, and urges the engaging unit 6*a* of the locking member 6 downward. The gripping part 6*d* is configured such that when it is brought upward against the urging force of the plate spring 6*c*, the engaging unit 6*a* is released from the engagement with the concavity 5*d* of the ink sheet case 5, as shown in FIG. 11. The ink sheet case 5 can thereby be removed from the ink sheet insertion part 1*c* of the frame 1. Also, the bent section 1*d* with which the plate spring 6*c* of the locking member 6 comes into contact is formed at the top of the second side surface 1*b* of the frame 1.

Figure 6:
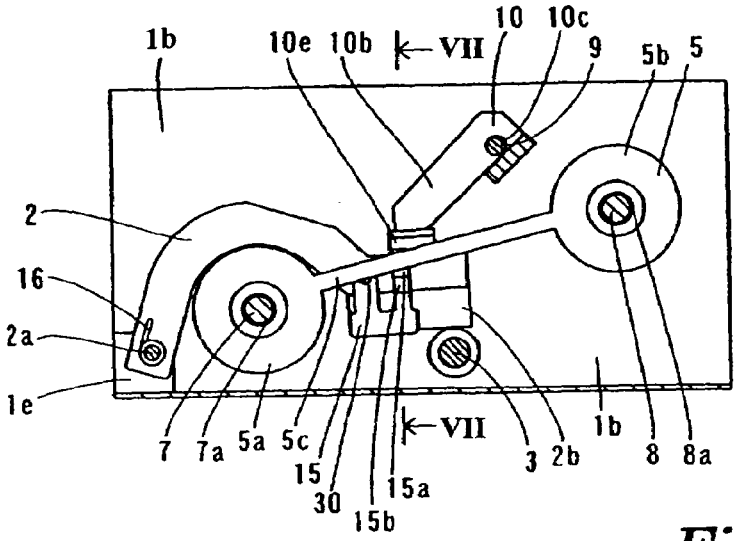
FIG. 6 is a schematic side elevational view of the heat transfer printer shown in FIGS. 1 and 2 according to the embodiment of the present invention, showing a printing state in which the contact unit is in contact with the linking unit of the ink sheet case.

Cut-out parts 1*e* for rotatably supporting the supporting shaft 2*a* of the thermal head unit 2 are formed in the inner sides of the first side surface 1*a* and the second side surface 1*b* of the frame 1, as shown in FIG. 3. The torsion coil spring 16 for urging the thermal head unit 2 in a direction away from the platen roller 3 is mounted on the supporting shaft 2*a* of the thermal head unit 2 next to the first side surface 1*a* of the frame 1. Also, the head bottom part 2*b* formed at the bottom of the thermal head unit 2 is disposed facing the platen roller 3 so as to hold ink sheets (not shown) between itself and the platen roller 3 during the printing operation, as shown in FIG. 6.

Figure 5:
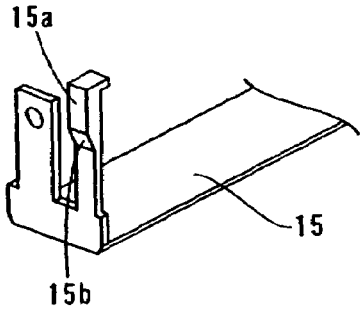
FIG. 5 is a partial perspective view for of the contact unit and the paper guide member of the heat transfer printer shown in FIGS. 1 and 2 according to the embodiment of the present invention.

In the present embodiment, the paper guide member 15 made of a resin for guiding the paper being conveyed is coupled to the thermal head unit 2 with a screw 30, as shown in FIGS. 2 and 4. The paper guide member 15 is unitarily formed with a contact unit 15*a* having a slanted part 15*b* that tapers off downward decreasing its thickness, as shown in FIG. 5. When the pivot member 10 is pressed and pivoted from the non-printing state shown in FIGS. 8 and 9 to the printing operation state in FIGS. 6 and 7, it is possible to allow the contact unit 15*a* to engage the linking unit 5*c* of the ink sheet case 5 smoothly because of the slanted part 15*b* of the contact unit 15*a*.

Figure 7:
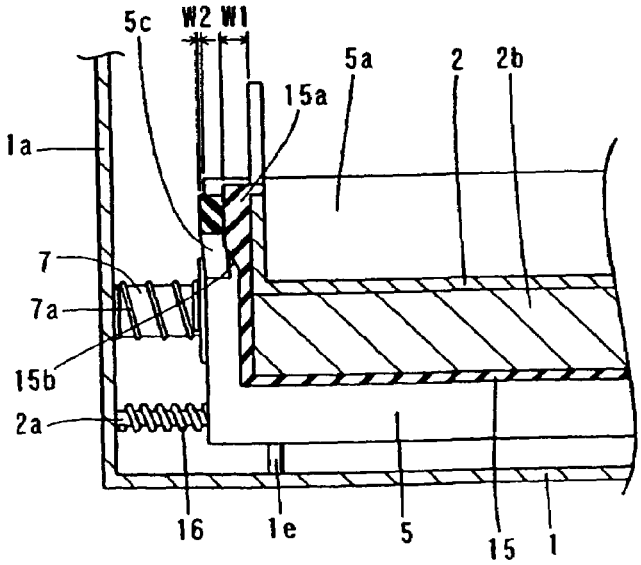
FIG. 7 is a partial cross-sectional view of the heat transfer printer according to the embodiment of the present invention viewed along the line VII—VII in FIG. 6.

The contact unit 15*a* made of a resin has a thickness (shown as W1 in FIG. 7) of about 2 mm, as shown in FIG. 7. The contact unit 15*a* is configured so as to come into contact with the inner side of the linking unit 5*c* of the ink sheet case 5 during the printing operation. While the linking unit 5*c* engages the contact unit 15*a*, the linking unit 5*c* of the ink sheet case 5 that is made of a resin is designed to elastically deflect outward by about 0.2 mm to 0.3 mm (which is shown as W2 in FIG. 7). The paper guide member 15 is thereby pressed towards the second side surface 1*b* of the frame 1 as shown in FIG. 3 by the urging force of the linking unit 5*c*. Therefore, the thermal head unit 2 is pressed towards the second side surface 1*b* of the frame 1 and comes into contact with the cut-out parts 1*e* of the frame 1.

Also, both ends of the supporting rod 9 are rotatably inserted into insertion holes 1*f* in the first side surface 1*a* and the second side surface 1*b* of the frame 1, as shown in FIG. 2. The pivot member 10 is formed into a square-like shape having a first arm 10*a* and a second arm 10*b*. Holes 10*c* for mounting the supporting rod 9 are formed in the first arm 10*a* and the second arm 10*b* of the pivot member 10. Also, a cam pin 10*d* is formed in the first arm 10*a* of the pivot member 10. This cam pin 10*d* is disposed so as to engage a cam groove 11*a* in the drive gear 11 mounted on the first side surface 1*a* of the frame 1, as shown in FIG. 1. Also, a pressing unit 10*e* is provided in the second arm 10*b* of the pivot member 10. This pressing unit 10*e* is disposed so as to apply pressure on the thermal head 2 at near the width direction (the direction of the arrow A in FIG. 1) center of the thermal head 2 by pivoting.

Also, the drive gear 11 is mounted on the first side surface 1*a* of the frame 1 and is made to engage the small gear 14*b* of the intermediate gear 14, as shown in FIG. 3. The cam groove 11*a* (see FIG. 1) for engaging the cam pin 10*d* in the first arm 10*a* of the pivot member 10 is formed in the side of the drive gear 11. Also, the driving force of the motor 13 is transmitted to the drive gear 11 via the motor shaft gear 13*a* and the intermediate gear 14.

Printing Operation

Next, the pressing operation for the platen roller 3 of the thermal head unit 2 in the heat transfer printer according to the present embodiment of the present invention will be described with reference to FIGS. 1, 3, 6, and 8.

Figure 8:
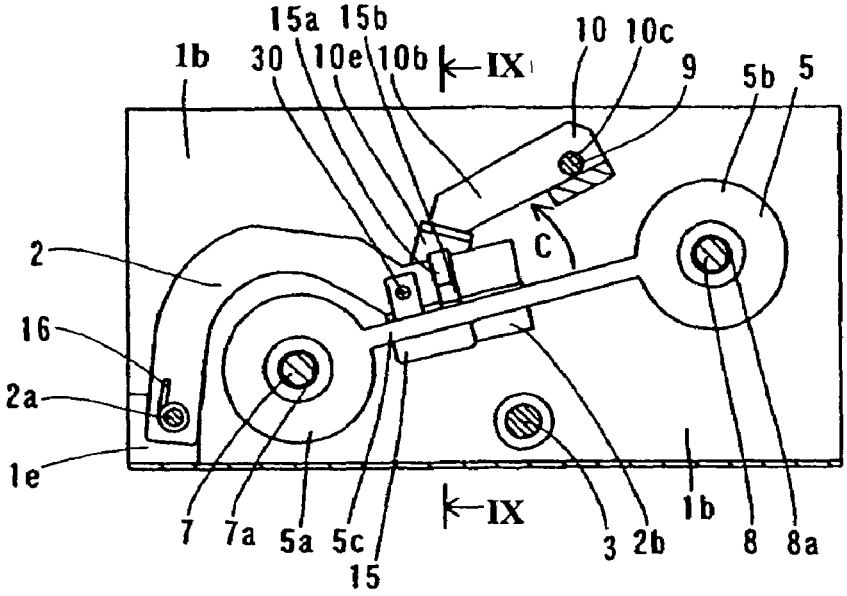
FIG. 8 is a schematic side elevational view of the heat transfer printer shown in FIGS. 1 and 2 according to the embodiment of the present invention, showing a non-printing state in which the contact unit is not in contact with the linking unit of the ink sheet case.
Figure 9:
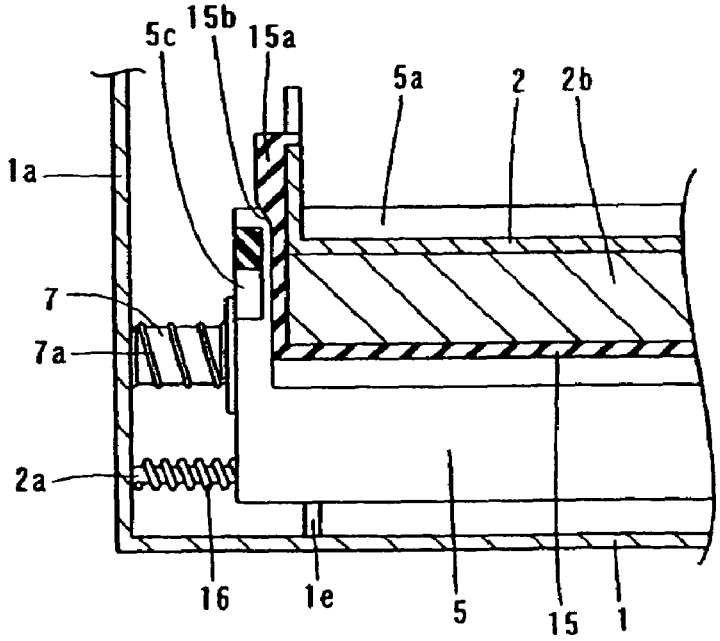
FIG. 9 is a partial cross-sectional view of the heat transfer printer according to the embodiment of the present invention viewed along the line IX—IX in FIG. 8.

First, in the initial state, the thermal head unit 2 is pivoted in a direction away from the platen roller 3 (the direction of the arrow C) by the urging force of the torsion coil spring 16, as shown in FIG. 8. Here, the contact unit 15*a* of the paper guide member 15 is located above the linking unit 5*c* of the ink sheet case 5. From this state, the driving force of the motor 13 is transmitted to the drive gear 11 from the motor shaft gear 13*a* via the large gear 14*a* and the small gear 14*b* of the intermediate gear 14, as shown in FIG. 3. The driving force is transmitted from the cam groove 11*a* of the drive gear 11 to the first arm 10*a* of the pivot member 10 via the cam pin 10*d* of the pivot member 10, as shown in FIG. 1. Thereby, the first arm 10*a* of the pivot member 10 pivots in the direction of the arrow B, and the second arm 10*b* of the pivot member 10 also pivots in the direction of the arrow B. Accordingly, the pressing unit 10*e* of the second arm 10*b* of the pivot member 10 presses on the thermal head unit 2, as shown in FIG. 6. The head bottom part 2*b* of the thermal head unit 2 is thereby pressed against the platen roller 3 in spite of the urging force of the torsion coil spring 16. Also, the contact unit 15*a* of the paper guide member 15 comes into contact with the inner side of the linking unit 5*c* of the ink sheet case 5.

In the present embodiment, as described above, the locking member 6 is provided with an engaging unit 6*a* that secures the ink sheet case 5 in place and also engages the ink sheet case 5. Also, the paper guide member 15 that is mounted on the thermal head unit 2 is provided with the contact unit 15*a* for preventing the ink sheet case 5 from moving during the printing operation. Therefore, even when the engaging unit 6*a* of the locking member 6 is inadvertently released from the concavity 5*d* of the ink sheet case 5 due to the locking member 6 being brought up by mistake during the printing operation, it is possible to prevent the ink sheet case 5 from being moved relative to the thermal head unit 2 because of the contact unit 15*a* of the paper guide member 15 mounted on the thermal head unit 2. It is thereby possible to reduce the occurrence of printing defects.

Also, in the present embodiment, the ink sheet case 5 is provided with the ink sheet feeder 5*a*, the ink sheet take-up unit 5*b*, and the linking unit 5*c* that links the ink sheet feeder 5*a* with the ink sheet take-up unit 5*b*. The contact unit 15*a* is designed to come into contact with the linking unit 5*c* of the ink sheet case 5 during the printing operation. Accordingly, it is possible to easily prevent the ink sheet case 5 from moving relative to the thermal head unit 2.

Also, in the present embodiment, at least one of the linking unit 5*c* of the ink sheet case 5 and the contact portion

15*a* of the paper guide member 15 is designed to be deflected where the contact unit 15*a* of the paper guide member 15 comes into contact with the linking unit 5*c* of the ink sheet case 5. Accordingly, the thermal head unit 2 can be pressed towards the first side plate 1*a* by the urging force from the flexural deformation of the linking unit 5*c* of the ink sheet case 5. The thermal head unit 2 can thereby be prevented from moving toward the second side plate 1*b*. As a result, it is possible to reduce non-uniformities in printed image due to positioning misalignments in the thermal head unit 2.

Also, in the present embodiment, the paper guide member 15 for guiding paper is provided to the thermal head unit 2, and the contact unit 15*a* is formed integrally with the paper guide member 15. Therefore, there is no increase in the number of components even though the contact unit 15*a* is additionally provided.

Other Embodiments

The embodiment currently disclosed should be considered as merely an example in all respects and not as being restrictive. The range of the present invention is expressed by the patent claims and not by the above description of the embodiment, and further includes meanings equivalent to the range of the patent claims and all variations within this range.

(a) For example, in the embodiment described above, a heat transfer printer is given as an example of an image forming apparatus. However, the present invention is not limited to such construction, and can also be applied to image forming apparatuses other than a heat transfer printers as long as such image forming apparatus has a print head unit for printing.

(b) Also, in the embodiment described above, the contact unit 15*a* was formed unitarily with the paper guide unit 15. However, the present invention is not limited to such construction, and the contact unit may be provided separately from the paper guide unit.

(c) Also, in the embodiment described above, the contact unit 15*a* is brought into contact with the linking unit 5*c* of the ink sheet case 5. However, the present invention is not limited to such construction, and the contact unit can also be brought into contact with the ink sheet feeder 5*a* or the ink sheet take-up unit 5*b* of the ink sheet case 5. The contact unit can also be brought into contact with other portions of the ink sheet case.

Figure 12:
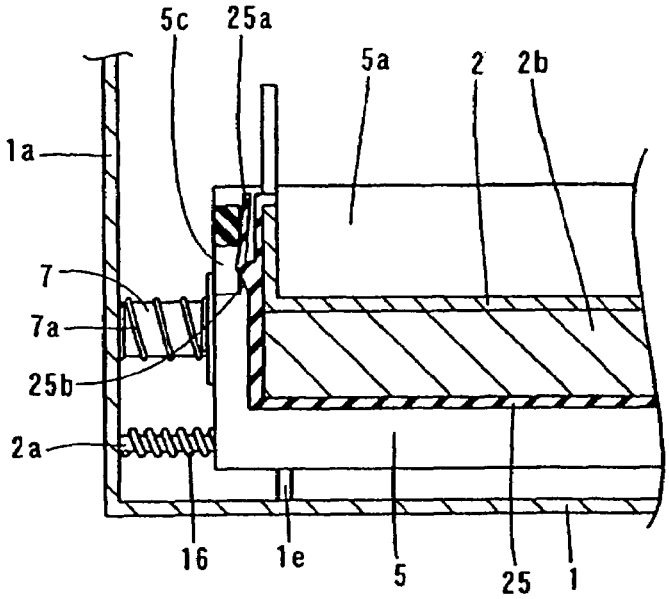
FIG. 12 is a partial cross-sectional view showing the detailed structure of the contact unit according to another embodiment of the present invention.
Figure 13:
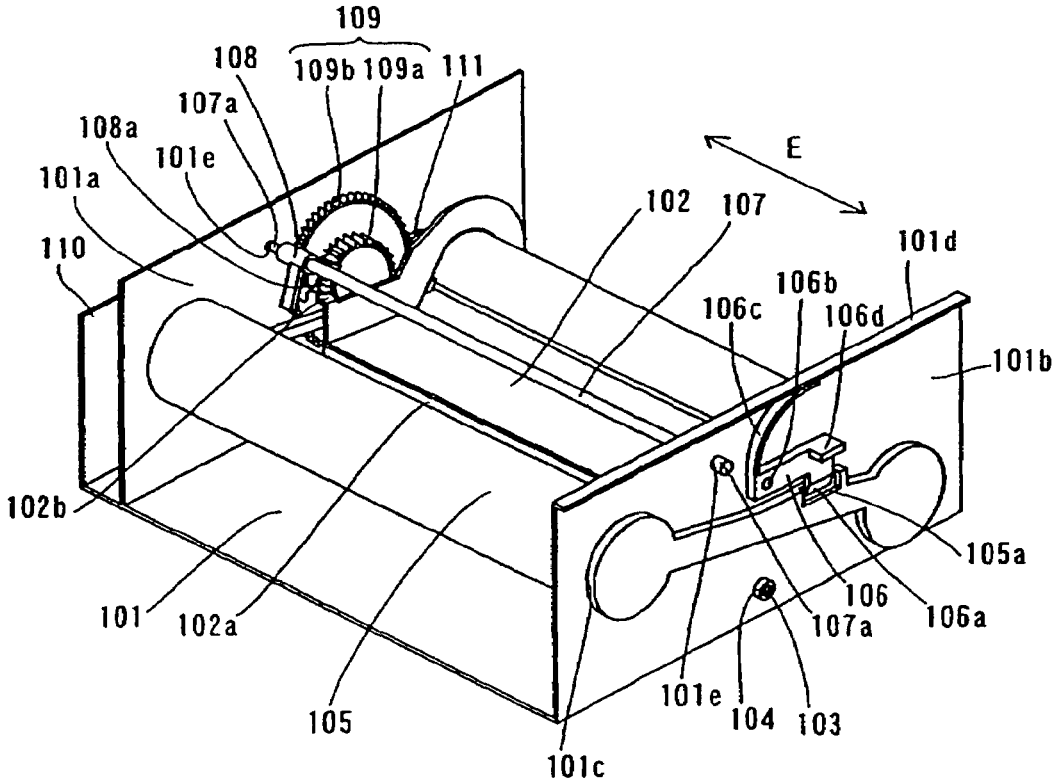
PRIOR ART Figure 13
FIG. 13 is a perspective view showing the entire configuration of a conventional example of a heat transfer printer.
Figure 14:
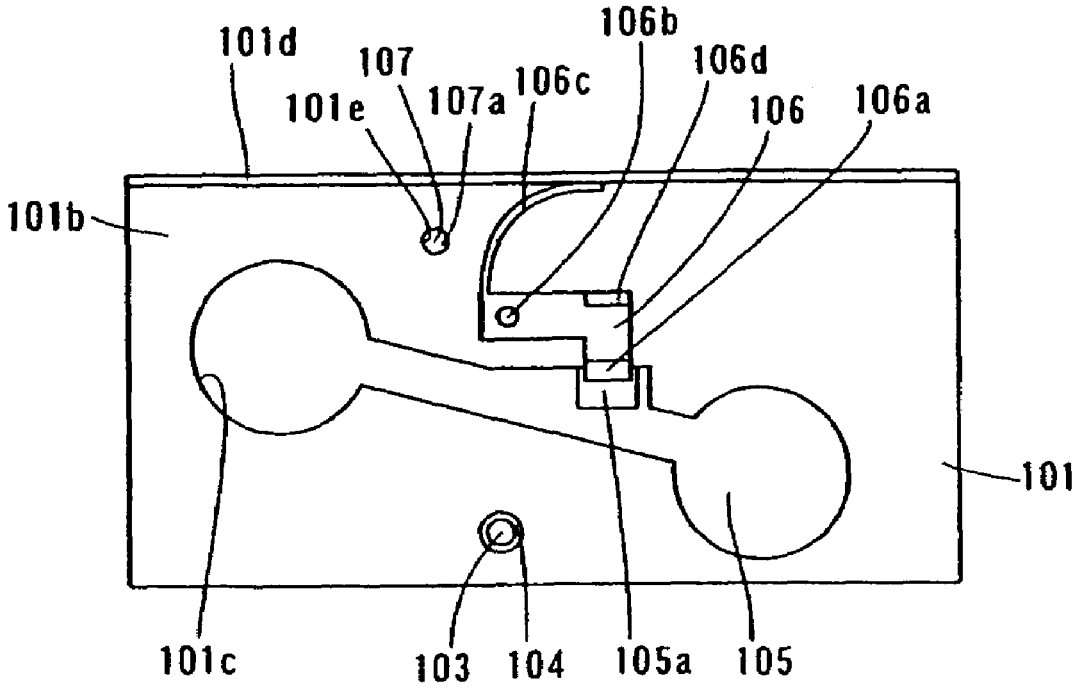
PRIOR ART Figure 14
FIG. 14 is a front view showing the locking member in the conventional heat transfer printer shown in FIG. 13, in which the locking member is engaged with the ink sheet case.

(d) Also, in the embodiment described above, the linking unit 5*c* of the ink sheet case 5 is elastically bended and deformed during the printing operation. However, the present invention is not limited to such construction. As shown in FIG. 12, a paper guide member 25 made of a resin may be provided with a contact unit 25*a* having a structure that is shaped as a plate spring and is prone to elastic deformation, as shown in FIG. 12. In this case, the linking unit 5*c* of the ink sheet case 5 may either be configured so as to bend or not to bend. In this case, the contact unit 25*a* is preferably formed so as to have a slanted part 25*b* that tapers off decreasing its thickness in a downward direction as shown in FIG. 12.

Here, in view of the similarity between the first and the preceding embodiments, the parts of the two embodiments that are identical are given the same reference numerals as the parts of the first embodiment. Moreover, the descriptions of the parts that are identical to the parts of the first embodiment are omitted for the sake of brevity.

As used herein, the following directional terms "forward, rearward, above, downward, vertical, horizontal, below and transverse" as well as any other similar directional terms refer to those directions of a device equipped with the present invention. Accordingly, these terms, as utilized to describe the present invention should be interpreted relative to a device equipped with the present invention.

The term "configured" as used herein to describe a component, section or part of a device includes hardware and/or software that is constructed and/or programmed to carry out the desired function.

Moreover, terms that are expressed as "means-plus function" in the claims should include any structure that can be utilized to carry out the function of that part of the present invention.

The terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

This application claims priority to Japanese Patent Application No. 2004-173391. The entire disclosure of Japanese Patent Application No. 2004-173391 is hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. An image forming apparatus adapted to form an image on a sheet, comprising:

a main frame having first and second side plates, an insertion part being formed on the second side plate;

a platen roller rotatably supported in the main frame;

a print head unit supported in the main unit so as to be pivotable between an image-forming state and a non-image forming state, the print head unit being pressed against the platen roller to convey a sheet therebetween when the print head unit is in the image-forming state;

a sheet case adapted to accommodate a sheet, the sheet case being designed to be mounted in the main frame through the insertion part; and a contact portion that is attached to the print head unit so as to pivot together with the print head unit, the contact portion contacting the sheet case from a second side plate side when the print head unit is in the image-forming state.

2. The image forming apparatus according to claim 1, wherein the sheet case includes a sheet feeder, a sheet take-up unit, and a linking unit that links the sheet feeder and the sheet take-up unit, and the contact portion comes into contact with the linking unit of the sheet case when the print head unit is in the image-forming state.

3. The image forming apparatus according to claim 1, wherein at least one of the contact portion and the linking unit of the sheet case is elastically deformed when the print head unit is in the image-forming state and the contact portion is in contact with the linking unit of the sheet case.

4. The image forming apparatus according to claim 1, further comprising a guide unit that is coupled to the print head unit and is adapted to guide the sheet being conveyed, wherein the contact portion is formed unitarily with the guide unit.

5. The image forming apparatus according to claim 1, further comprising a locking member that is provided in the second side plate of the main frame and designed to disengageably engage the sheet case.

6. The image forming apparatus according to claim 1, wherein at least one of the contact portion and the sheet case is elastically deformed when the print head unit is in the image-forming state and the contact portion is in contact with the sheet case.

7. The image forming apparatus according to claim 6, further comprising a guide unit that is coupled to the print head unit and is adapted to guide the sheet being conveyed, wherein the contact portion is formed unitarily with the guide unit, and the contact portion is elastically deformed when the print head unit is in the image-forming state and the contact portion is in contact with the sheet case.

8. The image forming apparatus according to claim 7, wherein the contact portion has a tapered part that decreases its thickness in a downward direction.

9. The image forming apparatus according to claim 1, wherein the print head unit is a thermal head, and the image forming apparatus is a heat transfer printer.

10. An image forming apparatus adapted to form an image on a sheet, comprising a main frame having first and second side plates, an insertion part being formed on the second side plate;

a platen roller rotatably supported in the main frame;

a print head unit supported in the main unit so as to be pivotable between an image-forming state and a non-image forming state, the print head unit being pressed against the platen roller to convey a sheet therebetween when the print head unit is in the image-forming state;

a sheet case adapted to accommodate a sheet, the sheet case being designed to be mounted in between the first and second side plates of the main frame through the insertion part, the sheet case including a sheet feeder, a sheet take-up unit, and a linking unit that links the sheet feeder and the sheet take-up unit;

a contact portion that is attached to the print head unit so as to pivot together with the print head unit, the contact portion contacting the linking unit of the sheet case from a second side plate side and at least one of the contact portion and the linking unit of the sheet case being elastically deformed when the print head unit is in the image-forming state;

a guide unit that is coupled to the print head unit and is adapted to guide the sheet being conveyed, the contact portion being formed unitarily with the guide unit; and a locking member that is provided in the second side plate of the main frame and designed to disengageably engage the sheet case.

* * * * *